US005957271A

United States Patent [19]

Marchini

[11] Patent Number: 5,957,271

[45] Date of Patent: Sep. 28, 1999

[54] PUSH-BUTTON ASSEMBLIES

[75] Inventor: Barry Allen Marchini, West Sussex, United Kingdom

[73] Assignee: Starpoint Electric Limited, West Sussex, United Kingdom

[21] Appl. No.: 08/930,326

[22] PCT Filed: Mar. 15, 1996

[86] PCT No.: PCT/GB96/00646

§ 371 Date: Sep. 11, 1997

§ 102(e) Date: Sep. 11, 1997

[87] PCT Pub. No.: WO96/29717

PCT Pub. Date: Sep. 26, 1996

[30] Foreign Application Priority Data

| | | | |
|---|---|---|---|
| Mar. 17, 1995 | [GB] | United Kingdom | 9505446 |
| Sep. 25, 1995 | [GB] | United Kingdom | 9519513 |

[51] Int. Cl.[6] ..... H01H 3/12

[52] U.S. Cl. ..... 200/345

[58] Field of Search ..... 200/345, 306, 200/515

[56] References Cited

U.S. PATENT DOCUMENTS

| | | | |
|---|---|---|---|
| 5,310,973 | 5/1994 | Lee | 200/515 X |

FOREIGN PATENT DOCUMENTS

| | | |
|---|---|---|
| 33 25 491 A1 | 12/1984 | Germany . |
| 94 00 632 | 5/1994 | Germany . |
| 5-290672 | 5/1993 | Japan . |
| 2 239 352 | 6/1991 | United Kingdom . |
| 2271216 | 4/1994 | United Kingdom . |
| 2279500 | 1/1995 | United Kingdom . |

*Primary Examiner*—Renee S. Luebke

*Attorney, Agent, or Firm*—Sugrue, Mion, Zinn, Macpeak & Seas, PLLC

[57] ABSTRACT

A push-button assembly (10) is constituted by a push-button (12) having a side wall outer surface located adjacent to a side wall inner surface of a surrounding body (14). In the assembly, at least one of the side wall surfaces is recessed (22; 22*a*, 22*c*; 22*b*, 22*d*), thereby reducing the contact area of the opposed surface areas likely to be adversely affected by stickiness.

2 Claims, 2 Drawing Sheets

PUSH-BUTTON ASSEMBLIES

BACKGROUND OF THE INVENTION

The present invention relates to improvements in push-button assemblies which should allow more reliable operation in adverse conditions.

Typically, a push-button is associated with a switch which is operated by movement of the push-button relatively to the switch. In a fruit machine, for example, a series of push-buttons may be provided, each being associated with a respective switch controlling a different game function, such as start, reel hold, etc. A player operates a selected switch by pressing its associated push-button which is thus moved relatively to a surrounding body. Typically, the surrounding body is in the form of a decorative bezel located at one end of a push-button switch mounting.

Examples of push-button switch mountings are disclosed in our GB-A-2239352, GB-A-2271216 and GB-A-2279500 to which the reader is instructed to refer.

A problem has been experienced in that, particularly in bars or public houses, liquids such as beer or lemonade are spilled and penetrate between a side wall of the push-button and a side wall of the surrounding body, causing the side walls to become sticky.

Even if the push-button does not completely jam in the surrounding body, the stickiness may slow the movement of the push-button and cause an unacceptable delay in the operation of the switch, particularly in games where speed is of the essence.

SUMMARY OF THE INVENTION

According to the present invention, however, a push-button assembly comprises a push-button having a side wall outer surface located adjacent to a side wall inner surface of a surrounding body, characterised in that at least one of said side wall surfaces is recessed.

The term "recessed" is intended to mean any surface which is not uniformly flat or curved but has projection(s) and/or depression(s).

The expectation is that the invention will significantly reduce the effect of stickiness particularly for push-button assemblies of comparatively large size having large opposed surface areas which are especially likely to be adversely affected by stickiness.

Preferably, the side wall outer surface of the push-button is recessed as a result of including a series of grooves spaced apart from one another around the external periphery of the side wall of the push-button. Additionally, or alternatively, the side wall inner surface of the surrounding body is recessed as a result of including a series of grooves spaced apart from one another around the internal periphery of the side wall of the surrounding body.

The push-button may comprise a cap and a spring-biased support, either or both of which is or are recessed.

The surrounding body may comprise a push-button switch mounting and a decorative bezel, either or both of which is or are recessed, with the decorative bezel being located at one end of the push-button switch mounting whose other end is adapted to permit mounting of a switch thereto.

Preferably, said at least one of said side wall surfaces is formed with at least one groove with the or each of said grooves being inclined with respect to the intended direction of movement of the push-button.

Also preferably, those of said grooves which are opposed to one another on opposed ones of said side wall surfaces are inclined in opposite directions so that the push-button assembly can be self-cleaning.

In any event, the grooves may be located in positions such that they are not visible when the push-button is assembled with the surrounding body, but the push-button and the surrounding body may otherwise be of conventional construction.

BRIEF DESCRIPTION OF THE DRAWINGS

Two push-button assemblies, in accordance with the present invention, will now be described in more detail, by way of example only, with reference to the accompanying drawings in which.

DETAILED DESCRIPTION OF THE PREFERRED EMBODIMENTS

Figure 1:
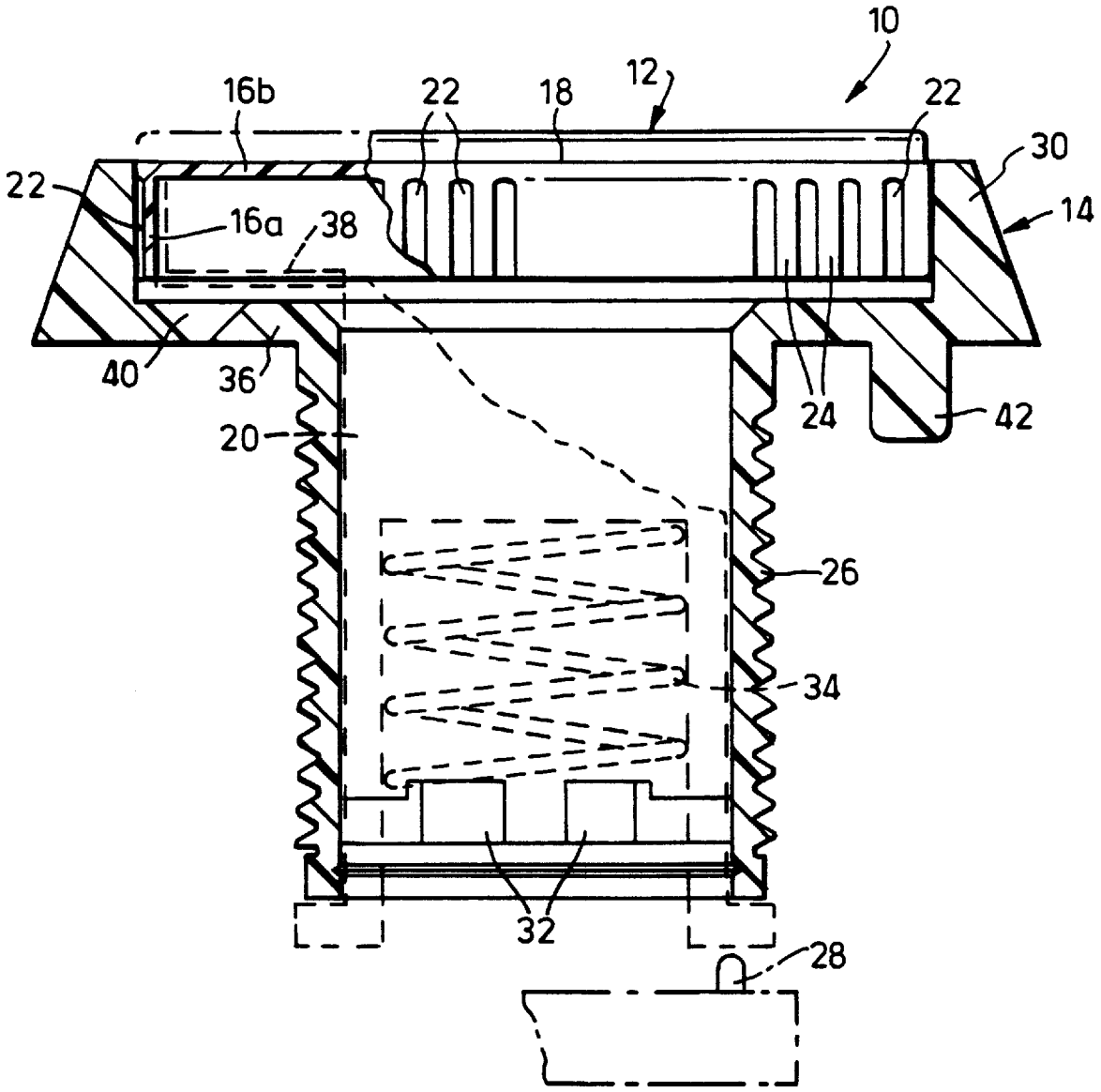
FIG. 1 is a schematic partly-sectioned side view of a first push-button assembly according to the present invention.

Each of the accompanying drawings shows a push-button assembly 10 comprising a push-button 12 and a surrounding body 14 each of which is formed of plastics material.

The push-button 12 has a side wall 16*a* defining a square, rectangular, circular or other shape spanned by an end wall 16*b* which may be domed or outwardly curved, the side wall 16*a* and the end wall 16*b* together defining a cap 18.

An internal periphery of the cap 18 is secured, for example as a push fit or a snap fit, around a spring-biased support 20 (shown in phantom) operable in a known manner to urge the cap 18 to the position illustrated, the spring-biased support 20 forming a lower part of the push-button 12.

In FIG. 1, an external periphery of the side wall 16*a* is formed with a series of grooves 22, of part-cylindrical cross-section, which are parallel to the direction of reciprocation of the push-button 12 and are separated by flat outer side wall portions 24.

The surrounding body 14 has a decorative bezel 30 at one end of a push-button switch mounting 26, shown as an externally threaded cylinder, whose other end mounts a microswitch 28 (shown in phantom) operated by the spring-biased support 20, in a known manner, when the cap 18 is pushed further in to the surrounding body 14, away from the position illustrated.

As is conventional, the microswitch 28 may be mounted by means of shaped lugs 32 extending inwardly of the push-button switch mounting 26. Moreover, again as is conventional, the shaped lugs 32 may abut one end of a helical spring 34 whose other end abuts the spring-biased support 20.

It will be appreciated that the decorative bezel 30 defines a recess having a bottom wall 36 opposed to a transverse wall 38 of the spring-biased support 20. Moreover, it will also be appreciated that the bottom wall 36 may be provided with one or more drain holes 40 as well as one or more locating studs 42.

An internal periphery of the surrounding body 14 is here shown as being unrecessed but it could similarly be provided with grooves either in addition to or as alternatives to the grooves 22.

Even if liquids are spilled between the external periphery of the push-button 12 and the internal periphery of the surrounding body 14, the fact that the side wall outer surface of the push-button 12 is recessed by the provision of the grooves 22 means that only the flat outer side wall portions 24 of the cap 18 are immediately adjacent to the side wall inner surface of the decorative bezel 30, thereby greatly reducing the opposed surface areas most likely to be adversely affected by stickiness.

Figure 2:
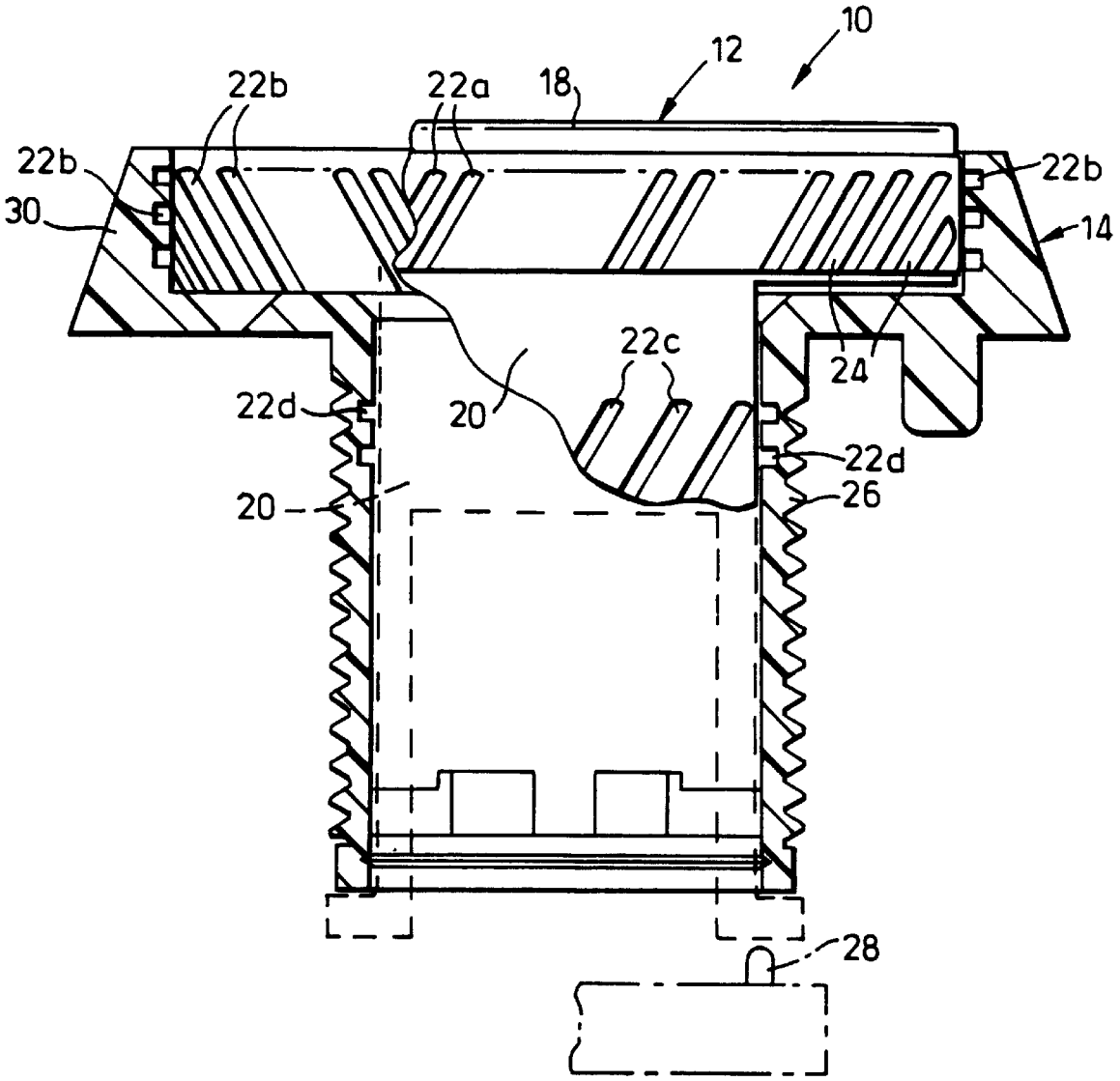
FIG. 2 is a schematic partly-sectioned side view of a second push-button assembly according to the present invention.

In FIG. 2, each side face of the external periphery of the cap 18 is formed with grooves 22*a* slanting in one direction, whereas each associated face of the internal periphery of the decorative bezel 30 is formed with grooves 22*b* slanting in an opposite direction.

Moreover, a part of the spring-biased support 20, forming the lower part of the push-button 12, has a side wall outer surface formed with grooves 22*c* slanting in one direction, whereas the side wall inner surface of an opposed part of the push-button switch mounting 26 is formed with grooves 22*d* slanting in an opposite direction.

It will be appreciated that the slanting flat portions between the slanting grooves in the embodiment of FIG. 2 reduce the contact area even more than in the embodiment of FIG. 1 thus presenting breaks which wipe over one another so that the push-button assembly can be self-cleaning.

It will further be appreciated that, rather than pluralities of inclined grooves 22*a*, 22*c*; 22*b*, 22*d* there could be one or more screw threads (which would be easier to mould). Alternatively, upstanding ribs could be formed on otherwise flat or curved surfaces to hold the opposed side wall surfaces away from one another. For example, the side faces of the internal periphery of the decorative bezel 30 could be formed with a pair of internally projecting ribs at each corner, whereas the cap 18 need not be recessed.

In a development, similar upstanding ribs or pips could be formed on either or both of the bottom wall 36 and the transverse wall 38 to resist sticking and formation of a vacuum therebetween the spring-biased support 20 and the bottom of the recess defined by the decorative bezel 30.

What is claimed is:

1. A push-button assembly, for use in a game playing machine, comprising a push-button movable in a predetermined direction relatively to a surrounding body;

the surrounding body including a decorative bezel which projects laterally outwardly of and is located at one end of a push-button switch mounting whose other end is adapted to permit mounting of a switch thereto, the push-button including a cap which is movable in said predetermined direction within the decorative bezel and a spring-biased support which is movable in said predetermined direction within the push-button switch mounting to permit operation of the switch thereby, and an outer surface of a side wall of the push-button being located adjacent to an inner surface of a side wall of the surrounding body;

characterised in that each of said side wall surfaces is formed with a plurality of slanted grooves, each of said slanted grooves being inclined with respect to said predetermined direction, and said pluralities of slanted grooves being opposed to one another and being inclined in opposite directions in order to reduce stickiness resulting from a liquid being spilled and penetrating between said side wall surfaces.

2. A push-button assembly according to claim 1, characterised in that each of said cap and said decorative bezel is formed with a respective plurality of said slanted grooves, and each of said spring-biased support and said push-button switch mounting is formed with a further respective plurality of said slanted grooves.

* * * * *